US008919766B1

(12) United States Patent
Shelhart et al.

(10) Patent No.: US 8,919,766 B1
(45) Date of Patent: Dec. 30, 2014

(54) COMPILER SHELF HAVING ROTATABLE CAM WITH HIGH-FRICTION LOBE

(71) Applicant: XEROX Corporation, Norwalk, CT (US)

(72) Inventors: Timothy G. Shelhart, West Henrietta, NY (US); Aaron M. Moore, Fairport, NY (US); Samuel P. Sadtler, Rochester, NY (US)

(73) Assignee: XEROX Corporation, Norwalk, CT (US)

( * ) Notice: Subject to any disclaimer, the term of this patent is extended or adjusted under 35 U.S.C. 154(b) by 0 days.

(21) Appl. No.: 14/162,337

(22) Filed: Jan. 23, 2014

(51) Int. Cl.

| | |
|---|---|
| ***B65H 29/38*** | (2006.01) |
| ***B65H 31/36*** | (2006.01) |
| ***B65H 31/04*** | (2006.01) |
| ***B65H 31/26*** | (2006.01) |

(52) U.S. Cl.
CPC ..... *B65H 31/36* (2013.01); *B65H 31/04* (2013.01); *B65H 31/26* (2013.01)
USPC ..... 271/177; 271/214; 271/218

(58) Field of Classification Search
USPC ..... 271/177, 180, 214, 218, 220; 270/58.27, 58.08
See application file for complete search history.

(56) References Cited

U.S. PATENT DOCUMENTS

| | | | |
|---|---|---|---|
| 5,289,251 | A | 2/1994 | Mandel et al. |
| 5,374,043 | A | 12/1994 | Mandel et al. |
| 5,409,202 | A | 4/1995 | Naramore et al. |
| 5,671,920 | A | 9/1997 | Acquaviva et al. |
| 6,908,079 | B2 | 6/2005 | Milillo et al. |

FOREIGN PATENT DOCUMENTS

| | | |
|---|---|---|
| EP | 0099248 | 1/1984 |

*Primary Examiner* — Michael McCullough
(74) *Attorney, Agent, or Firm* — Gibb & Riley, LLC

(57) ABSTRACT

An apparatus includes a compiler surface that receives sheets of media, and a registration surface positioned at one end of the compiler surface. The leading edges of the sheets of media contact and are aligned by the registration surface. A rotatable cam is positioned at the other end of the compiler surface. The rotatable cam has a lobe, and the surface of the lobe is a high-friction surface. When the rotatable cam is at a "first" rotation position, this causes the lobe to contact the bottom sheet as the sheets of media are received onto the compiler surface. When the rotatable cam is at a "second" rotation position, this causes the lobe to move out of the way and avoid contacting any of the sheets of media as the sheets of media are ejected from the compiler surface.

20 Claims, 4 Drawing Sheets

COMPILER SHELF HAVING ROTATABLE CAM WITH HIGH-FRICTION LOBE

BACKGROUND

Systems and methods herein generally relate to registration (alignment) of stacks of sheets, and more particularly to reducing paper sliding on compiler shelves to promote proper registration.

Many modern production devices output sheets of media, such as sheets of paper, transparencies, plastic sheets, ceramic sheets, metallic sheets, etc. These sheets are often output into stacks, and the stacks are more efficiently processed if all the sheets are aligned with each other. For example, many printing devices align a stack of sheets before stapling the stack.

Some compiling strategies send the lead edge of paper into the throat of a stapler. In front of the stapler, there is a narrow shelf (e.g., a compiler shelf) that helps guide the paper into the stapler and then provides support for the front portion of the paper as it begins to accumulate. The majority of the sheet body is then dropped onto the stack of previously compiled sets. The top of the stack, however, is located approximately below the narrow shelf and staplers (necessary for ejecting the newly compiled set onto the stack). This height delta can cause sheets to "walk downhill" as additional sheets are compiled, creating angled, poorly registered sets. Furthermore, this delta grows larger as small, stapled sets develop staple build-up.

SUMMARY

An exemplary apparatus herein includes a compiler surface (shelf) that receives sheets of media from a processing device, such as a printing device. The compiler shelf has a first end (e.g., back end), and has a second end (e.g., front edge) opposite the first end. For ease of nomenclature, the first sheet of a set of sheets of media supplied to the compiler shelf is arbitrarily referred to as the "bottom sheet." A registration surface (e.g., wall, stapler, etc.) is positioned at the back end of the compiler shelf. The registration surface is approximately perpendicular to the compiler shelf, and the leading edges of the sheets of media contact, and is aligned by, the registration surface.

Further, a rotatable cam is positioned at the front edge of the compiler shelf. The rotatable cam comprises a first lobe and a second optional lobe, and the surface of the first lobe and the second lobe are high-friction surfaces. By "high-friction" what is meant is that the first and second lobes each have a coefficient of friction that is at least two times (and potentially much higher, such as 10 times, 100 times, etc.) the coefficient of friction of the compiler shelf.

Further, an ejector device (which can be, for example, a stapler device or similar) can be positioned adjacent the compiler shelf. The ejector device moves from a retracted position to an extended position to push the sheets of media off the compiler shelf. A drive link (drive device) is connected to the ejector device and the rotatable cam.

When the ejector device is in the retracted position, this causes the drive link to position the rotatable cam at a "first" rotation position. When the rotatable cam is at such a "first" rotation position, this causes the first lobe to contact the bottom sheet as the sheets of media are received onto the compiler shelf. The high-friction surface of the first lobe allows the first lobe to maintain the leading edge of the bottom sheet against the registration surface, even as additional sheets of media are received on top of the bottom sheet.

Many devices can supply the sheets to the compiler shelf. For example, a sheet feeder can supply the sheets of media to the compiler shelf. Such a sheet feeder is positioned relative to the compiler shelf (e.g., above the compiler shelf) to allow the bottom sheet to avoid contacting the first lobe when the rotatable cam is at the first rotation position (at least as the sheet feeder supplies the bottom sheet to the compiler shelf).

Further, when the ejector device moves from the retracted position to the extended position, this causes the drive link to rotate the rotatable cam to a second rotation position. When the rotatable cam is at such a "second" rotation position, this causes the first lobe to move out of the way and avoid contacting any of the sheets of media as the sheets of media are ejected from the compiler shelf. A biasing member (spring, winding, flexible strip, etc.) can be connected to the rotatable cam. This biasing member biases the rotatable cam back to the first rotation position when the ejector device moves back to the retracted position.

Further, in structures that include the optional second lobe, rotation of the rotatable cam from the first rotation position past the second rotation position (e.g., to a third fully rotated position) causes the second lobe to drive the sheets of media off the compiler shelf as the sheets of media are ejected from the compiler shelf. For example, when the rotatable cam is in the first rotation position, the first lobe provides high friction to stop sheets from walking down hill. When the rotatable cam is in the second rotation position, this moves the friction surface of the first lobe clear of the set of sheets (through existing motion of the ejector arm) to allow easy stack ejection off the compiler shelf, without moving the second lobe far enough to contact any of the sheets.

Thus, neither the first or second lobes contact any sheets when the rotatable cam is in the second rotation position. Some sheets may, for various reasons, be skewed during ejection and, even though the center of the set of sheets may be pushed passed the compiler shelf by the ejector device, a skewed corner of a set may remain hung up on the compiler shelf. This can cause the following set(s) to not eject fully and, within a set or two, the machine can jam. This is where the second lobe on the rotatable cam is beneficial. The second lobe is designed as a last resort to "kick" a skewed (not fully ejected) set of sheets off the compiler shelf. This avoids a shutdown of the entire machine. With everything working correctly, the second lobe will simply swing through its motion without ever touching a set of sheets, and the second lobe only contacts the set of sheets if there is a problem during ejection, thereby preventing a shutdown.

Some devices herein can include an elevator platform that receives the newly compiled set of sheets of media as the set is ejected from the compiler shelf. The compiler shelf is not as long (from the first end to the second end) as a sheet of media and, therefore, the bottom sheet lies on and simultaneously contacts the compiler shelf and the elevator platform during the sheet stacking operation. The sheet stacking operation occurs prior to the set of sheets being ejected from the compiler surface. The elevator platform is positioned relative to the compiler shelf (e.g., below the compiler shelf) to cause the bottom sheet to contact the first lobe during this sheet stacking operation while the bottom sheet lies on, and simultaneously contacts, the compiler shelf and the elevator platform.

Stated more generically, the first end of the compiler shelf is positioned in a first plane, and the elevator platform is positioned in a different, second plane parallel to the first plane. The first plane is relatively above the second plane and, therefore, the first plane is not coplanar with the second plane. The front edge of the compiler shelf has a slope that extends from the first plane toward the second plane. The first lobe extends above (relative to such first and second planes) this slope when the rotatable cam is at the first rotation position. Conversely, the first lobe extends below (relative to such first and second planes) this slope when the rotatable cam is at the second rotation position, allowing the first lobe to not interfere with sheets of media sliding down the slope onto the elevator platform.

These and other features are described in, or are apparent from, the following detailed description.

BRIEF DESCRIPTION OF THE DRAWINGS

Various exemplary systems and methods are described in detail below, with reference to the attached drawing figures, in which.

DETAILED DESCRIPTION

As mentioned above, it can be difficult to align stacks of sheets used in, and output by, production equipment. In view of this, FIGS. 1-5 provide an exemplary apparatus herein that includes a compiler surface (shelf 134) that receives sheets of media 150 from a processing device, such as a printing device.

The compiler shelf 134 has a first end (e.g., back end), and has a second end (e.g., front edge) opposite the first end. For ease of nomenclature, the first sheet of a set of sheets of media 150 supplied to the compiler shelf 134 is arbitrarily referred to as the "bottom sheet." A registration wall (e.g., surface) is positioned at the back end of the compiler shelf 134. The registration wall 136 is approximately perpendicular to the compiler shelf 134, and the leading edges of the sheets of media 150 contact, and is aligned by, the registration wall 136.

Figure 4:
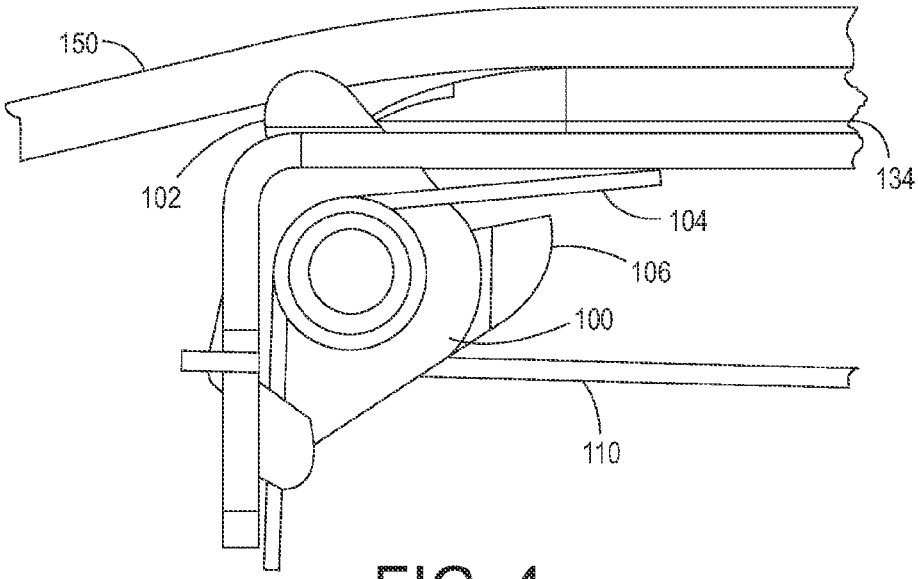
FIG. 4 is a schematic diagram illustrating devices herein.
Figure 5:
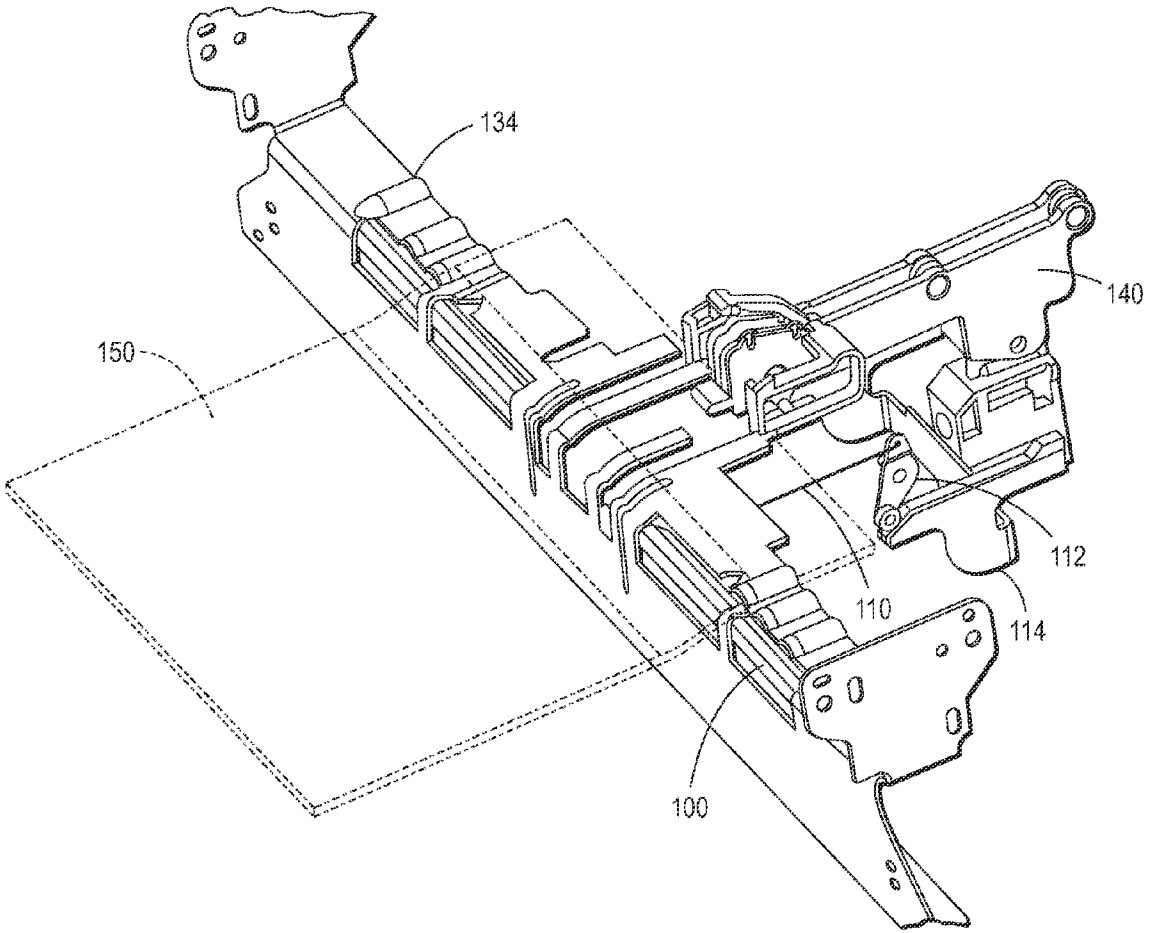
FIG. 5 is a schematic diagram illustrating devices herein.

Further, a rotatable cam 100 (which is illustrated in greater detail in FIG. 4, and comprises a circular (when viewed in cross-section) cylinder or shaft having oval lobes thereon) is positioned at the front edge of the compiler shelf 134. The rotatable cam 100 comprises a first lobe 102 and a second optional lobe 104, and the surface of the first lobe 102 and the second lobe 104 are high-friction surfaces. By "high-friction" what is meant is that the first and second lobes each have a coefficient of friction that is at least two times (and potentially much higher, such as 5 times, 10 times, 100 times, etc.) the coefficient of friction of the compiler shelf 134. Further, the round cylinder portion of the rotatable cam 100 can be made of the same or different material than the lobes 102, 104 and the same or different material than the compiler shelf 134. These materials can be metals, alloys, plastics, rubbers, ceramics, etc., and the different coefficients of friction can be achieved by use of different materials or by use of different surface textures.

Further, an ejector device (which can be, for example, a stapler device 140 or similar) can be positioned adjacent the compiler shelf 134. The ejector device 140 moves from a retracted position to an extended position to push the sheets of media 150 off the compiler shelf 134. A drive link including bar 110, lever 112, block cam (or wedge) 114, etc., (generally referred to herein as a drive device) is connected to the ejector device and the rotatable cam 100. Note that many elements can be connected to the general "frame" elements 138 illustrated in the drawings, as would be understood by those ordinarily skilled in the art.

Figure 1:
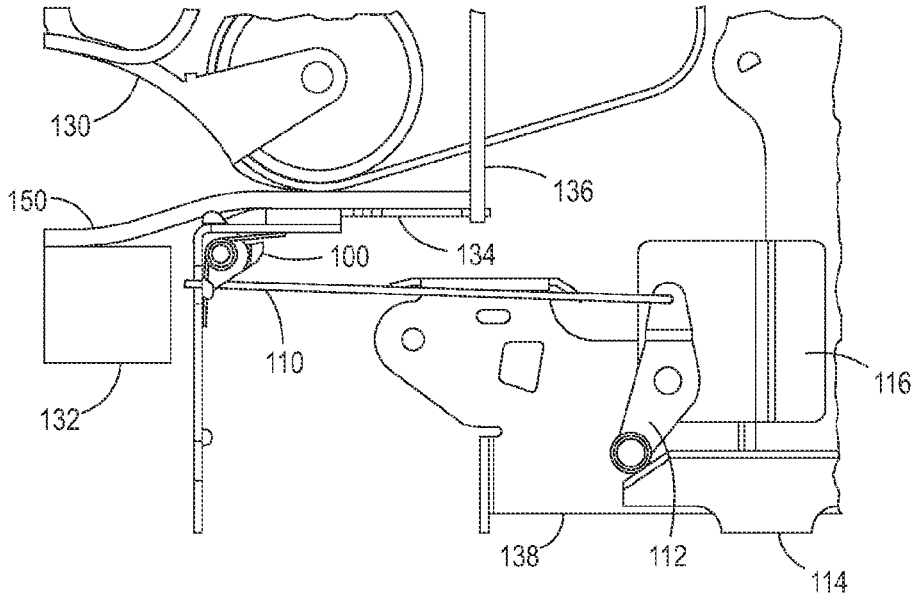
FIG. 1 is a schematic diagram illustrating devices herein.

When the ejector device 140 is in the retracted position, as shown in FIG. 1, this causes the drive link 110 to position the rotatable cam 100 at a "first" rotation position (by movement of the lever 112 over the surface shape of the block cam 114). When the rotatable cam 100 is at such a "first" rotation position, this causes the first lobe 102 to contact the bottom sheet as the sheets of media 150 are received onto the compiler shelf 134. The high-friction surface of the first lobe 102 causes the first lobe 102 to maintain the leading edge of the bottom sheet against the registration wall 136, even as additional sheets of media 150 are received on top of the bottom sheet.

Many devices can supply the sheets to the compiler shelf 134. For example, a sheet feeder 130 shown in FIG. 1 can supply the sheets of media 150 to the compiler shelf 134. Such as sheet feeder 130 is positioned relative to the compiler shelf 134 (e.g., relatively above the compiler shelf 134) to allow the bottom sheet to avoid contacting the first lobe 102 when the rotatable cam 100 is at the first rotation position as the sheet feeder 130 supplies the bottom sheet to the compiler shelf 134. After the sheet feeder 130 has completed feeding the bottom sheet to the compiler shelf 134, the bottom sheet will then contact the first lobe 102 and be held in place by the frictional surface of the first lobe 102 (but such relative positions allow the first lobe 102 to not impede the bottom sheet being fed onto the compiler shelf 134). Thus, only after the sheet 150 body falls onto the shelf 134 and stack 132 does the media actual contact the first lobe 102.

Figure 2:
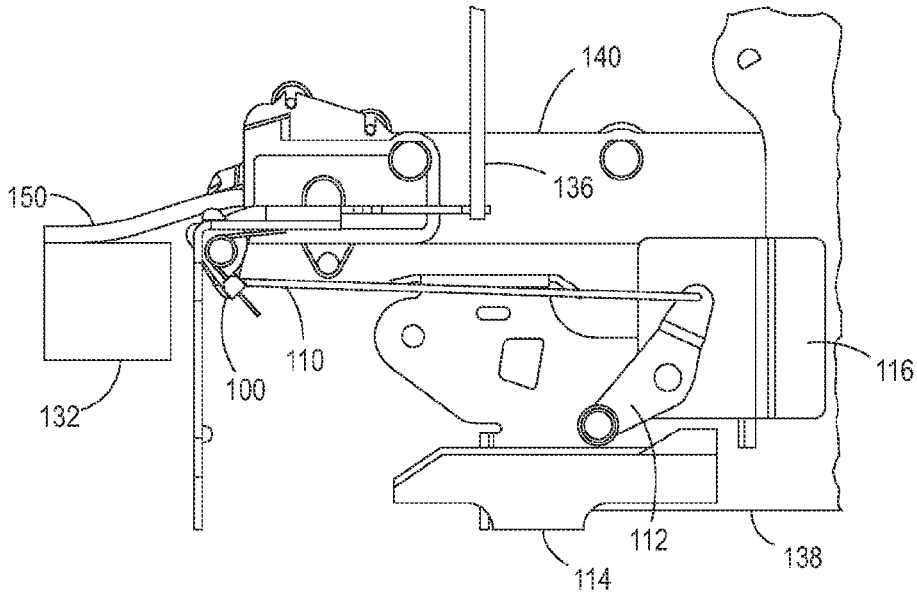
FIG. 2 is a schematic diagram illustrating devices herein.

Further, when the ejector device 140 moves from the retracted position to the extended position, as shown in FIG. 2, this causes the drive link 110 to rotate the rotatable cam 100 to a second rotation position (by movement of the lever 112 over the surface shape of the block cam 114 as the cam moves with the ejector device 140, to which it is connected). When the rotatable cam 100 is at such a "second" rotation position, this causes the first lobe 102 to move out of the way and avoid contacting any of the sheets of media 150 as the sheets of media 150 are ejected from the compiler shelf 134. A biasing member 104 (spring, winding, flexible strip, etc.) identified in FIG. 4 can be connected to the rotatable cam 100. This biasing member 104 biases the rotatable cam 100 back to the first rotation position when the ejector device 140 moves back to the retracted position. Thus, as shown, the biasing member 104 biases the cam 100 to the first (retracted) position and this causes the cam 100 to pull on the link 110, which in turn biases the lever 112 against the surface of the cam 114 (allowing the sloped-shaped and shelf-parallel areas of the block shape of the block cam 114 surface to control the rotation of the cam 100 according to movement of the ejector device 140).

Figure 3:
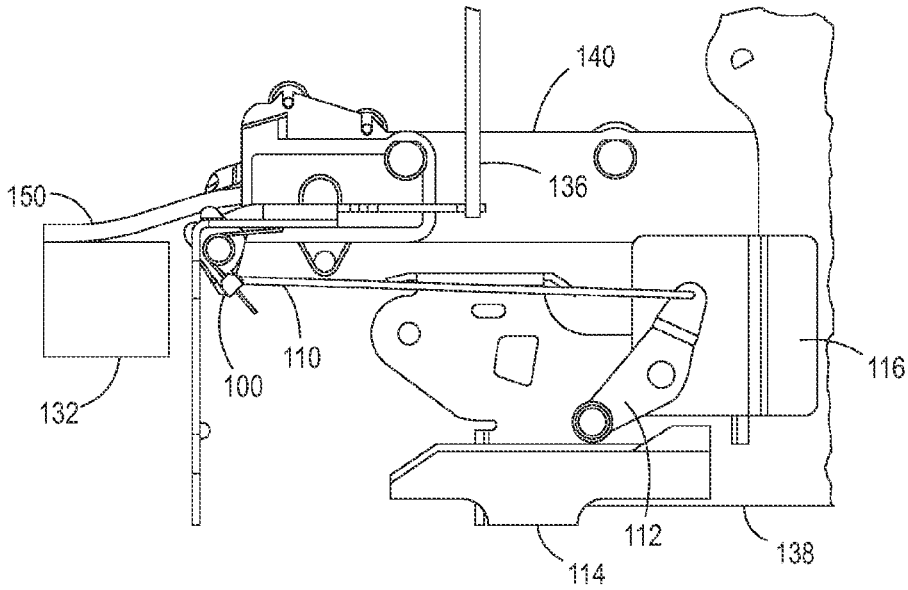
FIG. 3 is a schematic diagram illustrating devices herein.

Further, in structures that include the optional second lobe 104, continued rotation of the rotatable cam 100 from the first rotation position past the second rotation position (e.g., to a third fully rotated position, as shown in FIG. 3) causes the second lobe 104 to drive the sheets of media 150 off the compiler shelf 134 as the sheets of media 150 are ejected from the compiler shelf 134. Note, that as shown, the block cam 114 includes an additional feature (that the lever 112 contacts in FIG. 3) that rotates the cam 100 into the third rotation position.

For example, when the rotatable cam 100 is in the first rotation position, the first lobe 102 provides high friction to stop sheets from walking down hill. When the rotatable cam 100 is in the second rotation position, this moves the friction surface of the first lobe 102 clear of the set of sheets (through existing motion of the ejector arm) to allow easy stack ejection off the compiler shelf 134, without moving the second lobe 104 far enough to contact any of the sheets.

Thus, neither the first or second lobes contact any sheets when the rotatable cam 100 is in the second rotation position. Some sheets may, for various reasons, be skewed during ejection and, even though the center of the set of sheets may be pushed passed the compiler shelf 134 by the ejector device, a skewed corner of a set may remain hung up on the compiler shelf 134. This can cause the following set(s) to not eject fully and, within a set or two, the machine can jam. This is where the second lobe 104 on the rotatable cam 100 is beneficial. The second lobe 104 is designed as a last resort to "kick" a skewed (not fully ejected) set of sheets off the compiler shelf 134. This avoids a shutdown of the entire machine. With everything working correctly, the second lobe 104 will simply swing through its motion without ever touching a set of sheets, and the second lobe 104 only contacts the set of sheets if there is a problem during ejection, thereby preventing a shutdown.

Some devices herein can include an elevator platform 132 that receives the sheets of media 150 as the sheets of media 150 are ejected from the compiler shelf 134. The compiler shelf 134 is not as long (from the first end to the second end) as a sheet of media 150 and, therefore as shown in FIG. 1, the bottom sheet lies on and simultaneously contacts the compiler shelf 134 and the elevator platform 132 during the sheet stacking operation. The sheet stacking operation occurs prior to the sheets of media 150 being ejected from the compiler surface. The elevator platform 132 is positioned relative to the compiler shelf 134 (e.g., below the compiler shelf 134) to cause the bottom sheet to contact the first lobe 102 during this sheet stacking operation while the bottom sheet lies on and simultaneously contacts the compiler shelf 134 and the elevator platform 132 to maintain the leading edge of the bottom sheet against the registration wall 136, even as additional sheets of media 150 are received on top of the bottom sheet.

Stated more generically, the first end of the compiler shelf 134 is positioned in a first plane, and the elevator platform 132 is positioned in a different, second plane parallel to the first plane. The first plane is relatively above the second plane and, therefore, the first plane is not coplanar with the second plane. The front edge of the compiler shelf 134 has a slope that extends from the first plane toward the second plane. The first lobe 102 extends above (relative to such first and second planes) this slope when the rotatable cam 100 is at the first rotation position (FIG. 1). Conversely, the first lobe 102 extends below (relative to such first and second planes) this slope when the rotatable cam 100 is at the second rotation position (FIG. 2) allowing the first lobe 102 to not interfere with sheets of media 150 sliding down the slope onto the elevator platform 132. Also, the second lobe 104 extends above (relative to such first and second planes) this slope when the rotatable cam 100 is at the third rotation position (FIG. 3) causing the second lobe 104 to push sheets of media 150 down the slope onto the elevator platform 132. For purposes herein, terms such as "above" and "below" are used as they are commonly understood, with the orientation of the device being as it is shown in the drawings, having the bottom oriented toward the earth or the ground (or other gravitational source) and the top oriented opposite the ground. As would be understood by those ordinarily skilled in the art, because gravity acts on the sets of sheets of media, the sheets of media will tend to work toward the bottom (lower) areas of the drawings by operation of gravity.

Therefore, as shown above, the devices described herein include a high-friction, rubber-like edge 102 on the corner of a narrow compiler shelf 134 as shown in FIGS. 1-5. The lead edge of paper 150 contacts the shelf 134 at a location past the rubber edge 102 (to prevent stubbing) and only after the sheet 150 body falls onto the shelf 134 and stack 132 does the media actual contact the rubber 102. The high-friction edge 102 prevents the bottom of the stack 150 from walking downhill and therefore maintains in-set registration. This friction applies to the first sheet, because this sheet is the most problematic as it is sliding from paper to smooth steel of the compiler shelf 134. The remaining sheets in the set 150 are paper to paper, and have a less tendency to walk back, provided the sheet below is stationary. To prevent stubbing when the set is ejected onto the stack, the rubber edge 102 is rotated out of the way as the set is ejected, as shown in FIG. 3.

This structure provides a high-friction, retractable, rubber-like edge 102 at the corner of the compiler shelf 134. The entire shelf 134 cannot be high-friction or the sheets 150 would stub and jam when being driven into the stapler 140 throat. However, the sheets 150 do not contact the upstream corner of the compiler shelf when being fed into the staplers. By adding a high-friction material along the section 102 of the shelf 134, the sheet 150 can slide cleanly into the staplers 140, but the trail edge would fall on the friction material 102, and thus be prevented from walking downhill while the remaining sheets are compiled.

Further, the high-friction edge 102 for the compiler shelf 134 is mounted on a rotatable mechanism 100. When sets 150 are being compiled, the friction material 102 keeps the paper from walking, but during the ejection cycle the high-friction portion 102 of the shelf is rotated out of the path of the set being ejected, as shown in FIG. 3. This rotation is accomplished through the existing motion of the ejector arm and no new motors, input/output, or firmware is required to implement the design. After the set is ejected, the mechanism rotates further allowing a "kicker" (the second lobe 106) to sweep through the compiler shelf. This ensures that any skewed or otherwise poorly ejected sets do not get hung up on the shelf 134. This prevents stacking issues by causing the set 150 to always clear the shelf, so following sets can compile nominally.

Therefore, the devices herein provide a retractable high-friction element 102 to improve in-set registration quality. The high-friction material 102 prevents sheets from walking downhill, greatly improving in-set registration quality. Further, the retracting action of the friction material 102 prevents negative behavior during set ejection. The kicker 106 provides insurance against sets being left on the compiler shelf if skewed ejection occurs. These structures are low cost, because they use existing motors, input/outputs, etc.; and are quickly implemented into existing designs.

Figure 6:
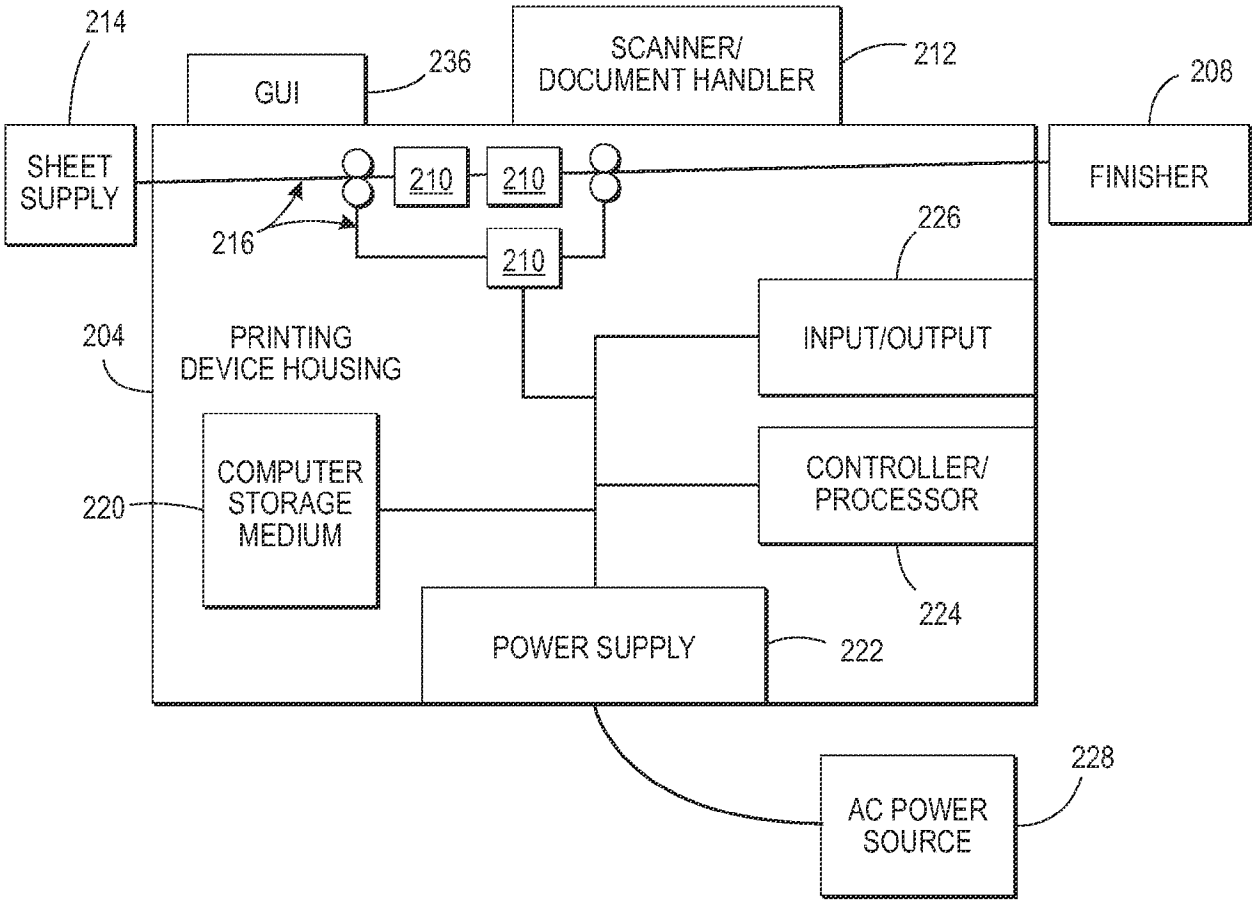
FIG. 6 is a schematic diagram illustrating devices herein.

FIG. 6 illustrates a computerized device that is a printing device 204, which can be used with systems and methods herein and can comprise, for example, a printer, copier, multi-function machine, multi-function device (MFD), etc. The printing device 204 includes a controller/processor 224 and a communications port (input/output) 226 operatively connected to the processor 224 and to the computerized network external to the printing device 204. Also, the printing device 204 can include at least one accessory functional component, such as a graphic user interface assembly 236 that also operate on the power supplied from the external power source 228 (through the power supply 222).

The input/output device 226 is used for communications to and from the printing device 204. The processor 224 controls the various actions of the computerized device. A non-transitory computer storage medium device 220 (which can be optical, magnetic, capacitor based, etc.) is readable by the processor 224 and stores instructions that the processor 224 executes to allow the computerized device to perform its various functions, such as those described herein. Thus, as shown in FIG. 6, a body housing has one or more functional components that operate on power supplied from an alternating current (AC) source 228 by the power supply 222. The power supply 222 can comprise a power storage element (e.g., a battery, etc.).

The printing device 204 includes at least one marking device (printing engines) 210 operatively connected to the processor 224, a media path 216 positioned to supply sheets of media from a sheet supply 214 to the marking device(s) 210, etc. After receiving various markings from the printing engine(s), the sheets of media can optionally pass to a finisher 208 that includes many of the components mentioned above and shown in FIGS. 1-5, and which can fold, staple, sort, etc., the various printed sheets. Also, the printing device 204 can include at least one accessory functional component (such as a scanner/document handler 212, etc.) that also operates on the power supplied from the external power source 228 (through the power supply 222).

While some exemplary structures are illustrated in the attached drawings, those ordinarily skilled in the art would understand that the drawings are simplified schematic illustrations and that the claims presented below encompass many more features that are not illustrated (or potentially many less) but that are commonly utilized with such devices and systems. Therefore, Applicants do not intend for the claims presented below to be limited by the attached drawings, but instead the attached drawings are merely provided to illustrate a few ways in which the claimed features can be implemented.

Many computerized devices are discussed above. Computerized devices that include chip-based central processing units (CPU's), input/output devices (including graphic user interfaces (GUI), memories, comparators, processors, etc.) are well-known and readily available devices produced by manufacturers such as Dell Computers, Round Rock Tex., USA and Apple Computer Co., Cupertino Calif., USA. Such computerized devices commonly include input/output devices, power supplies, processors, electronic storage memories, wiring, etc., the details of which are omitted herefrom to allow the reader to focus on the salient aspects of the systems and methods described herein. Similarly, scanners and other similar peripheral equipment are available from Xerox Corporation, Norwalk, Conn., USA and the details of such devices are not discussed herein for purposes of brevity and reader focus.

The terms printer or printing device as used herein encompasses any apparatus, such as a digital copier, bookmaking machine, facsimile machine, multi-function machine, etc., which performs a print outputting function for any purpose. The details of printers, printing engines, etc., are well-known and are not described in detail herein to keep this disclosure focused on the salient features presented. The systems and methods herein can encompass systems and methods that print in color, monochrome, or handle color or monochrome image data. All foregoing systems and methods are specifically applicable to electrostatographic and/or xerographic machines and/or processes.

In addition, terms such as "right", "left", "vertical", "horizontal", "top", "bottom", "upper", "lower", "under", "below", "underlying", "over", "overlying", "parallel", "perpendicular", etc., used herein are understood to be relative locations as they are oriented and illustrated in the drawings (unless otherwise indicated). Terms such as "touching", "on", "in direct contact", "abutting", "directly adjacent to", etc., mean that at least one element physically contacts another element (without other elements separating the described elements). Further, the terms automated or automatically mean that once a process is started (by a machine or a user), one or more machines perform the process without further input from any user.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. Unless specifically defined in a specific claim itself, steps or components of the systems and methods herein cannot be implied or imported from any above example as limitations to any particular order, number, position, size, shape, angle, color, or material.

What is claimed is:

1. An apparatus comprising:

a compiler surface receiving sheets of media, said compiler surface having a first end, and having a second end opposite said first end, a first sheet of a set of sheets of media supplied to said compiler surface comprising a bottom sheet;

a registration surface positioned at said first end of said compiler surface, leading edges of said sheets of media contacting and being aligned by said registration surface;

a rotatable cam positioned at said second end of said compiler surface, said rotatable cam comprising a lobe, and a surface of said lobe having a coefficient of friction at least two times a coefficient of friction of said compiler surface; and a drive device connected to said rotatable cam, said drive device positioning said rotatable cam at a first rotation position causing said lobe to contact said bottom sheet as said sheets of media are received onto said compiler surface, and said drive device positioning said rotatable cam at a second rotation position causing said lobe to avoid contacting any of said sheets of media as said sheets of media are ejected from said compiler surface.

2. The apparatus according to claim 1, further comprising a sheet feeder supplying said sheets of media to said compiler surface, said sheet feeder being positioned relative to said compiler surface to cause said bottom sheet to avoid contacting said lobe when said rotatable cam is at said first rotation position as said sheet feeder supplies said bottom sheet to said compiler surface.

3. The apparatus according to claim 1, further comprising an elevator platform receiving said sheets of media as said sheets of media are ejected from said compiler surface, said bottom sheet simultaneously contacting said compiler surface and said elevator platform during a sheet stacking operation occurring prior to said sheets of media being ejected from said compiler surface, and said elevator platform being positioned relative to said compiler surface to cause said bottom sheet to contact said lobe during said sheet stacking operation.

4. The apparatus according to claim 3, said first end of said compiler surface being positioned in a first plane, said elevator platform being positioned in a second plane parallel to said first plane, said first plane being other than coplanar with said second plane and said first plane being relatively above said second plane, said second end of said compiler surface comprising a slope extending from said first plane toward said second plane, said lobe extending above, relative to said first plane and said second plane, said slope when said rotatable cam is at said first rotation position, and said lobe extending below, relative to said first plane and said second plane, said slope when said rotatable cam is at said second rotation position.

5. The apparatus according to claim 1, said lobe maintaining said leading edge of said bottom sheet against said registration surface as additional ones of said sheets of media are received on top of said bottom sheet.

6. The apparatus according to claim 1, further comprising a biasing member connected to said rotatable cam, said biasing member biasing said rotatable cam to said first rotation position.

7. The apparatus according to claim 1, further comprising a stapler adjacent said compiler surface, said stapler ejecting said sheets of media from said compiler surface.

8. An apparatus comprising:

a compiler surface receiving sheets of media, said compiler surface having a first end, and having a second end opposite said first end, a first sheet of a set of sheets of media supplied to said compiler surface comprising a bottom sheet;

a registration surface positioned at said first end of said compiler surface, said registration surface being approximately perpendicular to said compiler surface, and leading edges of said sheets of media contacting and being aligned by said registration surface;

a rotatable cam positioned at said second end of said compiler surface, said rotatable cam comprising a first lobe and a second lobe, and a surface of said first lobe and said second lobe having a coefficient of friction at least two times a coefficient of friction of said compiler surface; and a drive device connected to said rotatable cam, said drive device positioning said rotatable cam at a first rotation position causing said first lobe to contact said bottom sheet as said sheets of media are received onto said compiler surface, said drive device rotating said rotatable cam from said first rotation position to a second rotation position causing said second lobe to drive said sheets of media off said compiler surface as said sheets of media are ejected from said compiler surface.

9. The apparatus according to claim 8, further comprising a sheet feeder supplying said sheets of media to said compiler surface, said sheet feeder being positioned relative to said compiler surface to cause said bottom sheet to avoid contacting said first lobe when said rotatable cam is at said first rotation position as said sheet feeder supplies said bottom sheet to said compiler surface.

10. The apparatus according to claim 8, further comprising an elevator platform receiving said sheets of media as said sheets of media are ejected from said compiler surface, said bottom sheet simultaneously contacting said compiler surface and said elevator platform during a sheet stacking operation occurring prior to said sheets of media being ejected from said compiler surface, and said elevator platform being positioned relative to said compiler surface to cause said bottom sheet to contact said first lobe during said sheet stacking operation.

11. The apparatus according to claim 10, said first end of said compiler surface being positioned in a first plane, said elevator platform being positioned in a second plane parallel to said first plane, said first plane being other than coplanar with said second plane and said first plane being relatively above said second plane, said second end of said compiler surface comprising a slope extending from said first plane toward said second plane, said first lobe extending above, relative to said first plane and said second plane, said slope when said rotatable cam is at said first rotation position, and said first lobe extending below, relative to said first plane and said second plane, said slope when said rotatable cam is at said second rotation position.

12. The apparatus according to claim 8, said first lobe maintaining said leading edge of said bottom sheet against said registration surface as additional ones of said sheets of media are received on top of said bottom sheet.

13. The apparatus according to claim 8, further comprising a biasing member connected to said rotatable cam, said biasing member biasing said rotatable cam to said first rotation position.

14. The apparatus according to claim 8, further comprising a stapler adjacent said compiler surface, said stapler ejecting said sheets of media from said compiler surface.

15. An apparatus comprising:

a compiler surface receiving sheets of media, said compiler surface having a first end, and having a second end opposite said first end, a first sheet of a set of sheets of media supplied to said compiler surface comprising a bottom sheet;

a registration surface positioned at said first end of said compiler surface, said registration surface being approximately perpendicular to said compiler surface, and leading edges of said sheets of media contacting and being aligned by said registration surface;

a rotatable cam positioned at said second end of said compiler surface, said rotatable cam comprising a first lobe and a second lobe, and a surface of said first lobe and said second lobe having a coefficient of friction at least two times a coefficient of friction of said compiler surface;

an ejector device adjacent said compiler surface, said ejector device moving from a retracted position to an extended position to push said sheets of media off said compiler surface; and a drive link connected to said ejector device and said rotatable cam, said ejector device being in said retracted position causing said drive link to position said rotatable cam at a first rotation position, said rotatable cam being at said first rotation position causing said first lobe to contact said bottom sheet as said sheets of media are received onto said compiler surface, said ejector device moving from said retracted position to said extended position causing said drive link to rotate said rotatable cam to a second rotation position, and rotation of said rotatable cam from said first rotation position to said second rotation position causing said second lobe to drive said sheets of media off said compiler surface as said sheets of media are ejected from said compiler surface.

16. The apparatus according to claim 15, further comprising a sheet feeder supplying said sheets of media to said compiler surface, said sheet feeder being positioned relative to said compiler surface to cause said bottom sheet to avoid contacting said first lobe when said rotatable cam is at said first rotation position as said sheet feeder supplies said bottom sheet to said compiler surface.

17. The apparatus according to claim 15, further comprising an elevator platform receiving said sheets of media as said sheets of media are ejected from said compiler surface, said bottom sheet simultaneously contacting said compiler surface and said elevator platform during a sheet stacking operation occurring prior to said sheets of media being ejected from said compiler surface, and said elevator platform being positioned relative to said compiler surface to cause said bottom sheet to contact said first lobe during said sheet stacking operation.

18. The apparatus according to claim 17, said first end of said compiler surface being positioned in a first plane, said elevator platform being positioned in a second plane parallel to said first plane, said first plane being other than coplanar with said second plane and said first plane being relatively above said second plane, said second end of said compiler surface comprising a slope extending from said first plane toward said second plane, said first lobe extending above, relative to said first plane and said second plane, said slope when said rotatable cam is at said first rotation position, and said first lobe extending below, relative to said first plane and said second plane, said slope when said rotatable cam is at said second rotation position.

19. The apparatus according to claim 15, said first lobe maintaining said leading edge of said bottom sheet against said registration surface as additional ones of said sheets of media are received on top of said bottom sheet.

20. The apparatus according to claim 15, further comprising a biasing member connected to said rotatable cam, said biasing member biasing said rotatable cam to said first rotation position.

* * * * *